US005595400A

United States Patent [19]

Wier

[11] Patent Number: 5,595,400

[45] Date of Patent: Jan. 21, 1997

[54] BUCKLE FOR SAFETY BELTS

[75] Inventor: Franz Wier, Göggingen, Germany

[73] Assignee: TRW Occupant Restraint Systems GmbH, Alfdorf, Germany

[21] Appl. No.: 589,086

[22] Filed: Jan. 23, 1996

[30] Foreign Application Priority Data

Jan. 26, 1995 [DE] Germany ..... 195 02 416.8

[51] Int. Cl.[6] ..... B60R 22/46

[52] U.S. Cl. ..... 280/806; 24/633; 24/642; 297/480

[58] Field of Search ..... 280/806; 297/480; 24/633, 642, 641, 645

[56] References Cited

U.S. PATENT DOCUMENTS

| | | | |
|---|---|---|---|
| 5,066,042 | 11/1991 | Föhl | 280/806 |
| 5,213,365 | 5/1993 | Föhl | 280/806 |
| 5,373,612 | 12/1994 | Kopetzky | 24/653 X |
| 5,446,068 | 3/1996 | Ball et al. | 24/642 X |

FOREIGN PATENT DOCUMENTS

| | | | |
|---|---|---|---|
| 3533684 | 2/1987 | Germany | 24/633 |
| 2083542 | 3/1982 | United Kingdom | 24/642 |

*Primary Examiner*—Christopher P. Ellis
*Attorney, Agent, or Firm*—Tarolli, Sundheim, Covell, Tummino & Szabo

[57] ABSTRACT

The pretensioner-proof buckle for safety belts has a latch (12) which is movably mounted in a load-bearing frame (10) between a release position and a fastening position and which in its fastening position acts on an insert tongue. A release button (14) is slidably mounted on the frame (10). Pressing of the button urges the latch (12) to its release position. A compensating mass forms one arm of a lever (16) pivotally mounted on the frame. The release button (14) has a pair of limit stops (14*a*, 14*b*) which are longitudinally spaced from each other. The lever (16) has a first lever arm (16*c*) the free end of which is located opposite the first limit stop (14*a*) of the release button, and a second lever arm (16*d*) the free end of which is located opposite the second limit stop (14*b*) of the release button.

3 Claims, 3 Drawing Sheets

Fig. 1
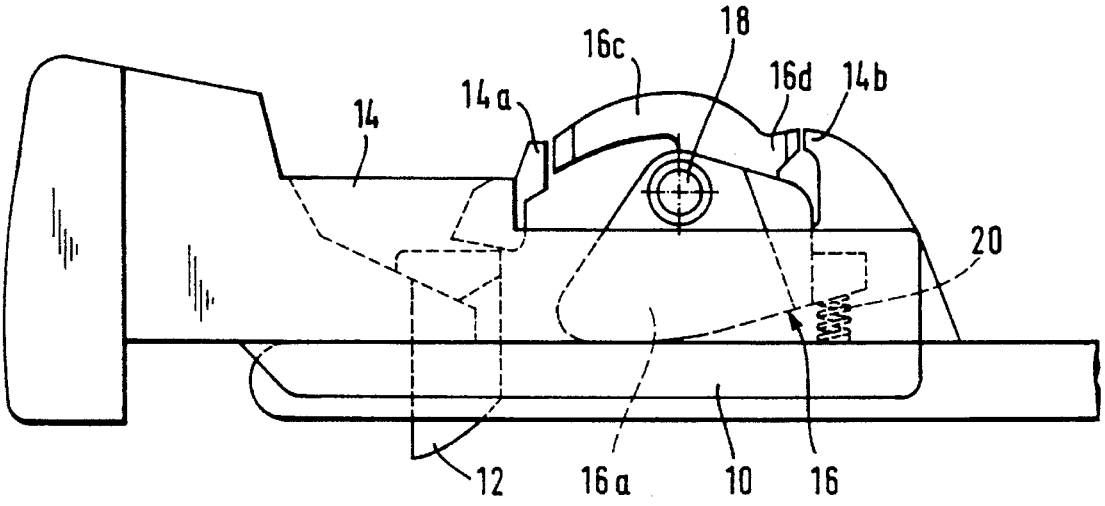
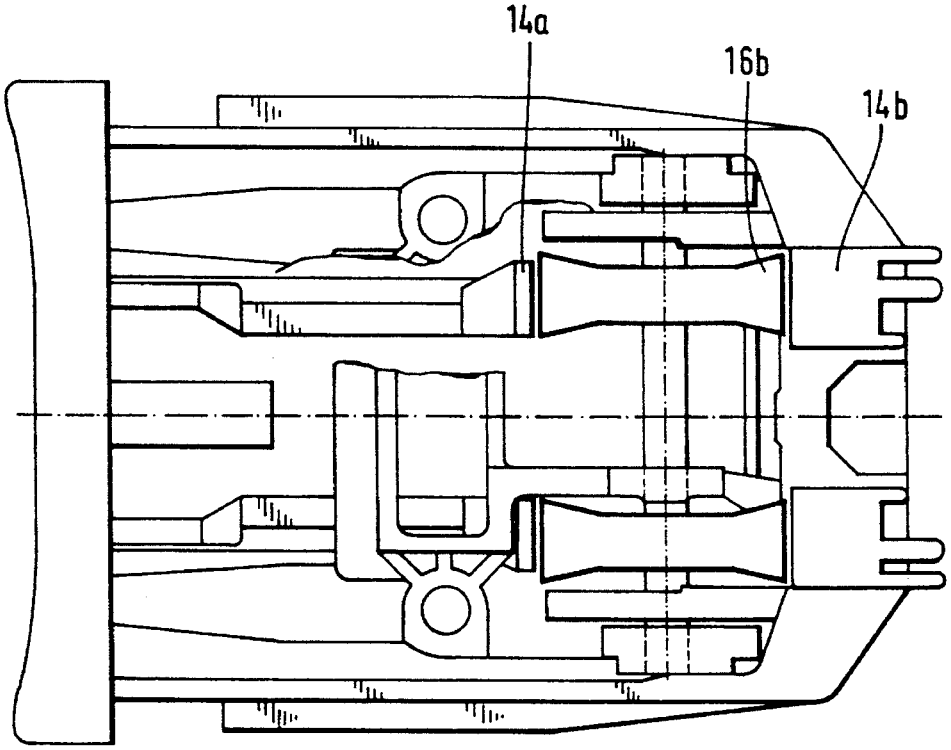
Fig. 2

BUCKLE FOR SAFETY BELTS

BACKGROUND OF THE INVENTION

The present invention relates to a buckle for safety belts suitable for a vehicular belt system with a seat-belt pretensioner acting on the buckle.

Such a buckle, a so-called pretensioner-proof buckle, is known from U.S. Pat. No. 5,066,042. It is fitted with a compensating mass to compensate for the forces of inertia occurring during extreme acceleration or deceleration and thus to prevent unintentional opening of the buckle. The compensating mass forms one arm of a lever pivotally mounted on the frame of the buckle. With a further arm, the lever acts on the release button of the buckle, and this button has a sliding mounting on the frame of this buckle.

SUMMARY OF THE INVENTION

The present invention provides a buckle with a high degree of safety, in order to reliably prevent the buckle from opening even under conditions of extreme acceleration or deceleration, also taking into account tolerances of manufacture and ageing.

In accordance with the invention, a buckle for safety belts is provided with a latch which is movably mounted in a load-bearing frame between a release position and a fastening position and which in its fastening position acts on an insert tongue. A release button is slidably mounted on the frame in a longitudinal direction. Pressing of the release button urges the latch to be pushed to its release position. A blocking lever forms a compensating mass and is pivotally mounted on the frame. The release button has a pair of limit stops or abutments which are spaced from each other in the longitudinal direction of the frame, and the lever has a first lever arm the free end of which is located opposite the first limit stop of the release button, and a second arm the free end of which is located opposite the second limit stop of the release button. The compensating mass is effective in principally the same way during deceleration and acceleration of the buckle, and overcompensation of the forces of inertia can be achieved by suitable dimensioning and suitable choice of its centre of gravity. This overcompensation results in an increased safety ensuring that unintentional opening of the buckle is prevented even under extreme conditions of use.

BRIEF DESCRIPTION OF DRAWINGS

Further characteristics and advantages of the invention are apparent from the following description of two designs and from the drawings to which reference is made. In the drawings, FIG. 1 shows a diagrammatic side view of a preferred embodiment of the buckle;

FIG. 2 shows a plan view of the buckle of FIG. 1;

DETAILED DESCRIPTION OF THE INVENTION

Figure 3A:
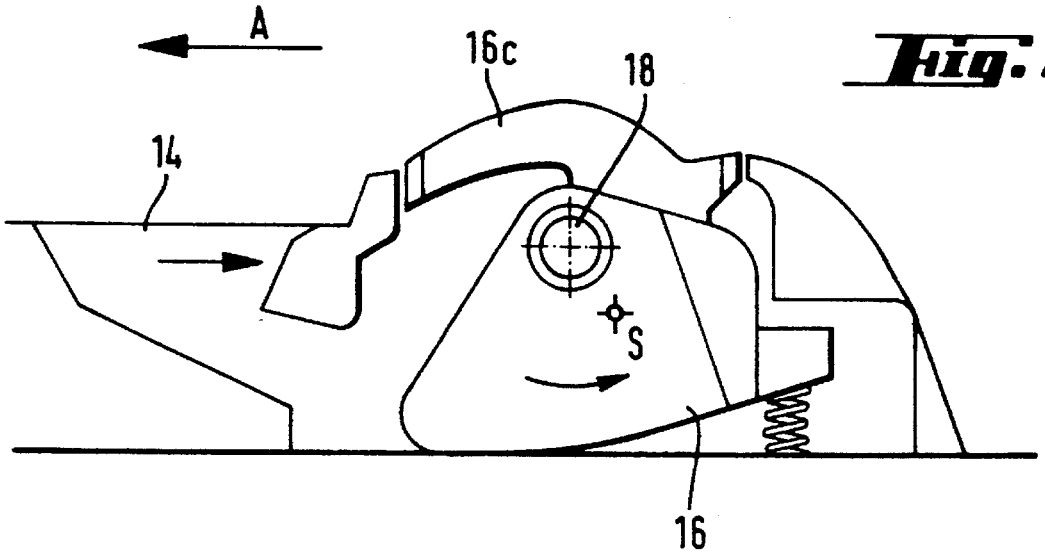
FIGS. 3*a* and 3*b* show diagrammatic side views of the buckle to clarify the functioning thereof.

FIG. 1 shows the main components of a buckle for safety belt systems. In a load-bearing frame 10 an insertion path is provided for an insert tongue. At right angles to this insertion path a latch 12 is slidably mounted in the frame 10. When the insert tongue is inserted in the path, the latch 12 extends through an opening in the tongue. Furthermore, on the frame 10 a release button 14 is slidably mounted for movement in a longitudinal direction of the frame 10. The latch 12 may be pushed into its release position by pressing the release button 14.

Furthermore, a lever 16 is pivotally mounted on the frame 10 about an axis 18. Lever 16 is integral with a pair of masses 16*a* and 16*b* spaced from each other laterally but rigidly connected to each other through axis 18, and these two masses 16*a* and 16*b* together form a compensating mass. Furthermore, opposite the masses 16*a* and 16*b* the lever 16 has a pair of lever arms 16*c* and 16*d*.

Two limit stops or abutments 14*a* and 14*b* are provided on the release button 14, and are spaced from each other in the longitudinal direction of the frame, i.e. in the direction of sliding movement of the release button 14. The spacing is such that the limit stops 14*a* and 14*b* are located in the longitudinal direction of the frame 10 on both sides of the free ends of the lever arms 16*c* and 16*d* so that these free ends are located opposite the limit stops 14*a* and 14*b* and are located at a short distance from them.

The lever 16 is biased into the initial position shown in FIG. 1 by a spring 20.

The lever 16 compensates for the forces of inertia occurring at the release button 14 during acceleration or deceleration of the buckle, particularly during the process of seat-belt tensioning by means of a tensioner which acts on the buckle and suddenly shifts the latter towards the floor of the vehicle. In case of normal operation of the release button 14 the limit stop 14*a* strikes the free end of the lever arm 16*c*, causing the latter to be swivelled in a clockwise direction. Since the rear limit stop 14*b* is shifted with the release button 14, the free end of the lever arm 16*d* strikes no obstacle; the release button 14 can therefore be actuated without hindrance.

FIG. 3*a* shows a diagrammatic view of the forces of inertia occurring in the case of an acceleration of the buckle in the direction of an arrow A. Through its inertial force, the release button 14 tends to shift in the opposite direction to arrow A. Lever 16, taking into account its lever arms 16*c* and 16*d* as well as the masses 16*a* and 16*b*, has a centre of gravity S. This centre of gravity is located below axis 18. Lever 16 therefore tends to carry out a counterclockwise swivelling movement as shown in FIG. 3*a*. The free end of the lever arm 16*c* strikes the limit stop 14*a*, whereby the movement of the release button 14 is blocked in the direction opposite to arrow A.

Figure 3B:
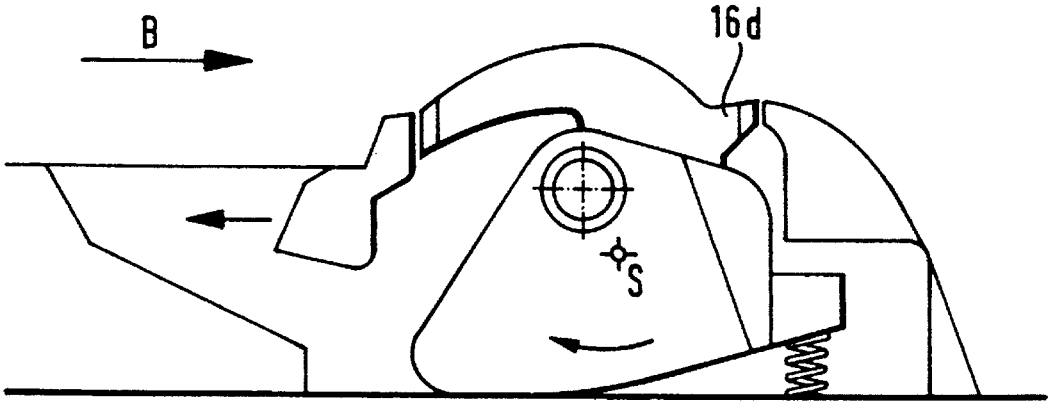

In case of acceleration in the opposite direction B as shown in FIG. 3*b*, lever 16 tends to show a clockwise swivelling movement. Consequently, lever 16, with its force of inertia, resists a movement of the release button 14 in the direction opposite to the acceleration direction B by means of lever arm 16*d*, against which limit stop 14*b* strikes. The release button 14 is therefore also blocked when acceleration occurs in direction B, which is opposed to direction A. Overcompensation can be achieved through appropriate dimensioning of masses 16*a* and 16*b*, taking into account the location of the centre of gravity S, so that the blocking forces produced by lever 16 are greater than the forces of inertia occurring at release button 14 which have to be overcome.

Figure 4:
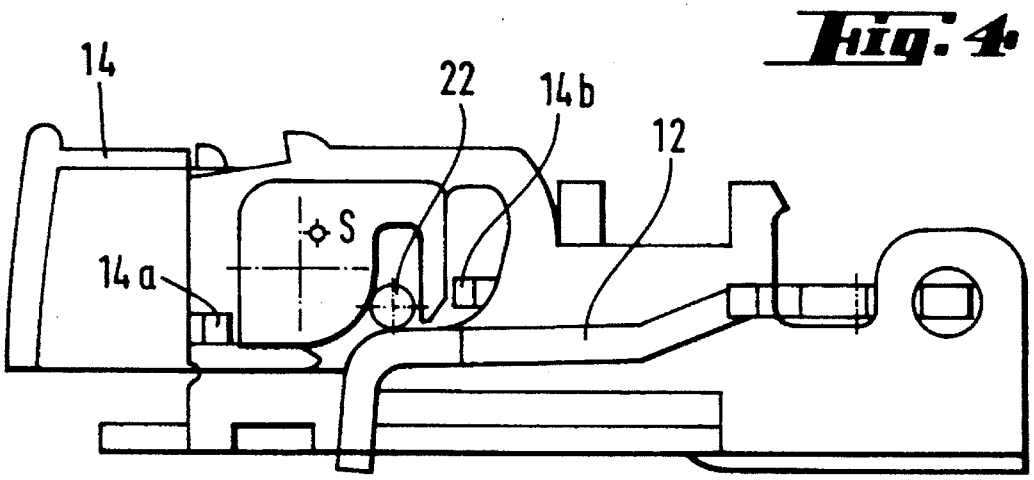
FIG. 4 shows a diagrammatic side view of a modified embodiment.
Figure 5:
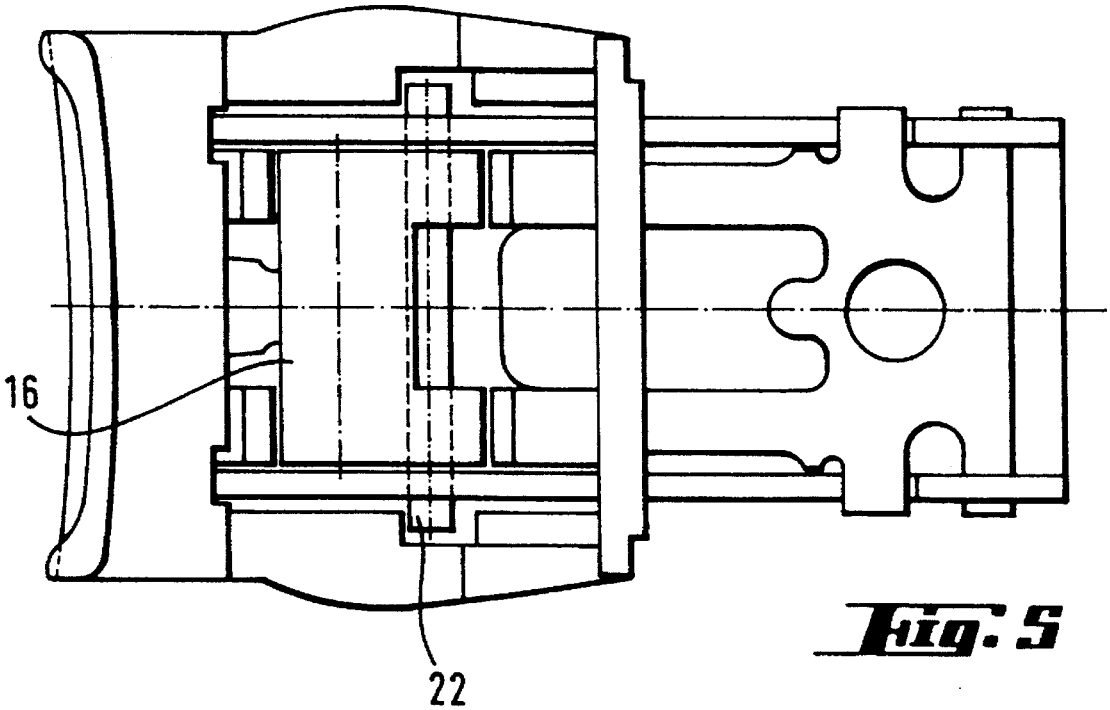
FIG. 5 shows a plan view of the buckle in accordance with the same embodiment.

In the second embodiment shown in FIGS. 4 and 5, a pivoted latch 12 is also mounted on the frame 10 of the buckle. The pivoted latch 12 is selectively retained in its closed position, or released, by a pin-shaped locking element 22, which has a sliding mounting on a level parallel to the insertion path of the frame 10. Apart from this indirect locking of the bolt 12, this buckle corresponds to the buckle described with reference to first design, and the function is analogous to that of the version described above.

What is claimed is:

1. A buckle for vehicular safety belt systems, comprising a frame, a latch movably mounted in said frame for movement between a release position and a fastening position, a release button slidably mounted on said frame for movement in a longitudinal direction of said frame, actuation of said release button urging said latch from the fastening position to the release position, at least one two-armed blocking lever with an integral inertial body pivotally mounted on said frame, and a pair of abutments provided on said release button spaced from each other in the longitudinal direction of said frame, said blocking lever being arranged between said abutments with each of its arms having an end facing one of said abutments.

2. The buckle of claim 1, wherein said blocking lever is spring biased to a stable rest position.

3. The buckle of claim 1, wherein a pair of said blocking levers are provided spaced from each other transverse to said longitudinal axis and interconnected by a common pivotal axis.

* * * * *